US007431434B2

(12) United States Patent
Agarwal et al.

(10) Patent No.: US 7,431,434 B2
(45) Date of Patent: Oct. 7, 2008

(54) FLUID EJECTION DEVICE

(75) Inventors: Arun K Agarwal, Corvallis, OR (US); Julie J Cox, Albany, OR (US); Jules G Moritz, Corvallis, OR (US); Ozgur Yildirim, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 376 days.

(21) Appl. No.: 11/140,802

(22) Filed: May 31, 2005

(65) Prior Publication Data

US 2006/0268067 A1 Nov. 30, 2006

(51) Int. Cl.
*B41J 2/05* (2006.01)

(52) U.S. Cl. ..... 347/65; 347/56; 347/63

(58) Field of Classification Search ..... 347/56, 347/63–65

See application file for complete search history.

(56) References Cited

U.S. PATENT DOCUMENTS 5,124,716 A 6/1992 Roy et al.
5,519,423 A 5/1996 Moritz, III et al.
5,874,974 A * 2/1999 Courian et al. ..... 347/65
5,898,448 A 4/1999 Ishikawa
5,946,012 A 8/1999 Courian et al.
6,042,222 A 3/2000 Moritz, III et al.
6,193,347 B1 * 2/2001 Askeland et al. ..... 347/15
6,247,798 B1 6/2001 Cleland et al.
6,409,318 B1 6/2002 Clark
6,443,564 B1 9/2002 Keil et al.
6,467,882 B2 10/2002 Inui et al.
6,502,915 B1 1/2003 Feinn et al.
6,536,878 B2 3/2003 Kasperchik et al.
6,561,632 B2 5/2003 Feinn et al.
6,565,195 B2 5/2003 Blair
6,729,715 B2 5/2004 Gonzalez

FOREIGN PATENT DOCUMENTS

EP 0705695 4/1996
EP 1122214 9/2001

* cited by examiner

*Primary Examiner*—Matthew Luu
*Assistant Examiner*—Henok Legesse

(57) ABSTRACT

A fluid ejection device includes a fluid chamber, a fluid restriction communicated with the fluid chamber, and a fluid channel communicated with the fluid restriction, wherein a width of the fluid restriction is in a range of approximately 8 microns to approximately 16 microns, and a length of the fluid restriction is in a range of approximately 5 microns to approximately 20 microns.

13 Claims, 5 Drawing Sheets

| | | | |
|---|---|---|---|
| Barrier Layer Thickness, T (um) | 14 +/- 1um | | |
| Orifice Layer Thickness, t (um) | 14 +/- 1um | | |
| **Ink Properties** | **Black** | **Color** | **Range** |
| Ink Viscosity (cP) | 1.8 | 2.5 | 1.5-3.0 |
| Ink Surface Tension (dynes/cm) | 58 | 29 | 20-60 |
| **System Performance** | **Black** | **Color** | **Range** |
| Drop Weight (ng) | 6.0 | 5.0 | 4.0-7.0 |
| Drop Velocity (m/s) | 12 | 12 | 10-15 |
| Frequency Range (kHz) | 0-24 | 0-36 | 0-36 |
| **Design Parameters** | **Black** | **Color** | **Range** |
| Resistor Area (um*um) | 403 | 452 | 350-500 |
| Resistor Size (um) | 20.1 | 21.3 | 18.7-22.4 |
| Orifice Diameter, d (um) | 14.4 | 15.0 | 13-16.5 |
| Pinch Width, W (um) | 8-10 | 10-16 | 8-16 |
| Pinch Length, L (um) | 10-20 | 5-10 | 5-20 |
| Shelf Length, D (um) | 61-71 | 51-61 | 46-76 |

*Fig. 7*

FLUID EJECTION DEVICE

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

In one arrangement, the printhead may accommodate different color inks, such as black ink and/or one or more colored inks. The different color inks, however, may have different properties and, therefore, different performance characteristics. Accordingly, to optimize performance of the printhead, it is desirable to select or tune parameters of the printhead to accommodate one or more different inks.

SUMMARY

One aspect of the present invention provides a fluid ejection device. The fluid ejection device includes a fluid chamber, a fluid restriction communicated with the fluid chamber, and a fluid channel communicated with the fluid restriction. As such, a width of the fluid restriction is in a range of approximately 8 microns to approximately 16 microns, and a length of the fluid restriction is in a range of approximately 5 microns to approximately 20 microns.

BRIEF DESCRIPTION OF THE DRAWINGS

FIG. 7 is a table outlining one embodiment of exemplary parameters and exemplary ranges of parameters of a fluid ejection device according to the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
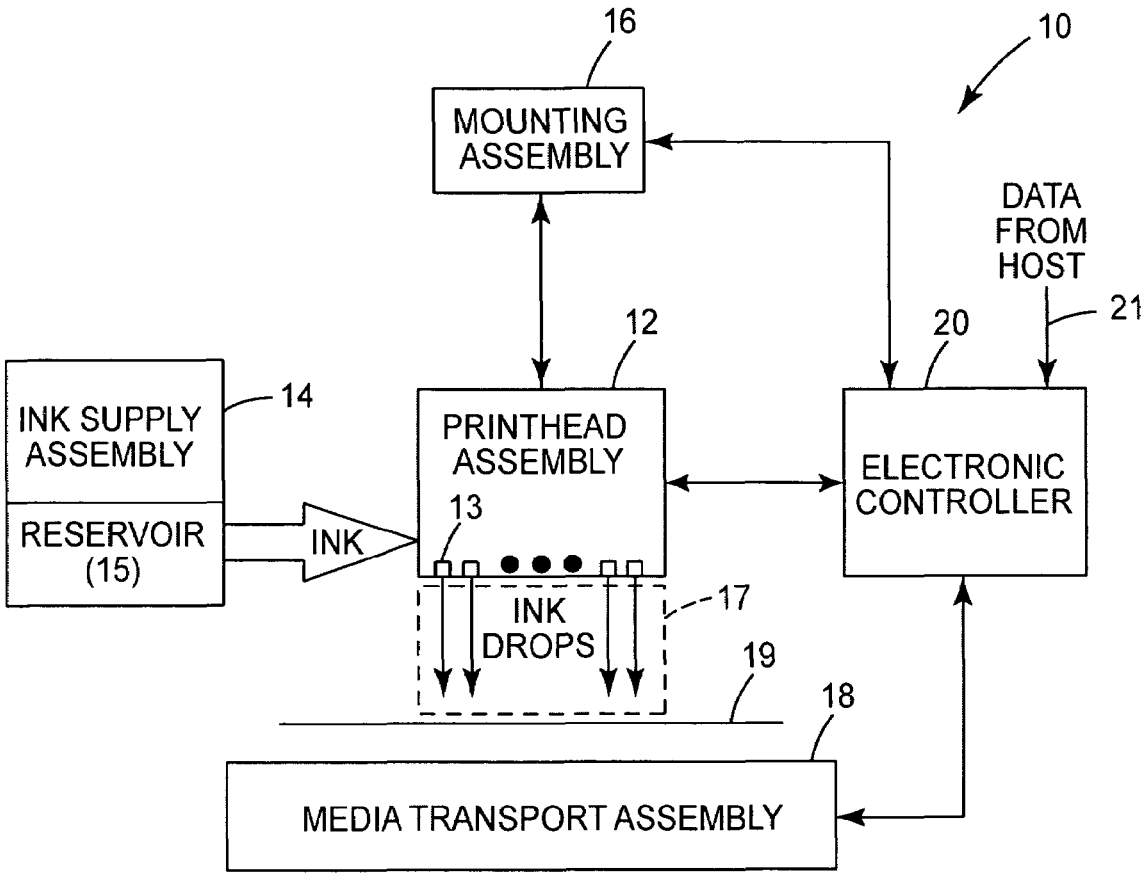
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
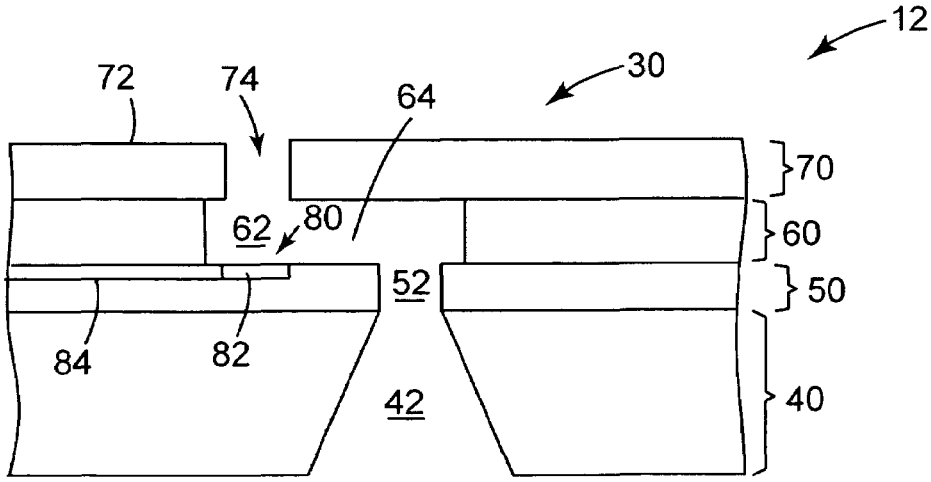
FIG. 2 is a schematic cross-sectional view illustrating one embodiment of a portion of a fluid ejection device according to the present invention.

FIG. 2 illustrates one embodiment of a portion of printhead assembly 12. Printhead assembly 12, as one embodiment of a fluid ejection device, includes an array of drop ejecting elements 30. Drop ejecting elements 30 are formed on a substrate 40 which has a fluid (or ink) feed slot 42 formed therein. As such, fluid feed slot 42 provides a supply of fluid (or ink) to drop ejecting elements 30.

In one embodiment, each drop ejecting element 30 includes a thin-film structure 50, a barrier layer 60, an orifice layer 70, and a drop generator 80. Thin-film structure 50 has a fluid (or ink) feed opening 52 formed therein which communicates with fluid feed slot 42 of substrate 40 and barrier layer 60 has a fluid ejection chamber 62 and one or more fluid channels 64 formed therein such that fluid ejection chamber 62 communicates with fluid feed opening 52 via fluid channels 64.

Orifice layer 70 has a front face 72 and an orifice or nozzle opening 74 formed in front face 72. Orifice layer 70 is extended over barrier layer 60 such that nozzle opening 74 communicates with fluid ejection chamber 62. In one embodiment, drop generator 80 includes a resistor 82. Resistor 82 is positioned within fluid ejection chamber 62 and is electrically coupled by leads 84 to drive signal(s) and ground.

While barrier layer 60 and orifice layer 70 are illustrated as separate layers, in other embodiments, barrier layer 60 and orifice layer 70 may be formed as a single layer of material with fluid ejection chamber 62, fluid channels 64, and/or nozzle opening 74 formed in the single layer. In addition, in one embodiment, portions of fluid ejection chamber 62, fluid channels 64, and/or nozzle opening 74 may be shared between or formed in both barrier layer 60 and orifice layer 70.

In one embodiment, during operation, fluid flows from fluid feed slot 42 to fluid ejection chamber 62 via fluid feed opening 52 and one or more fluid channels 64. Nozzle opening 74 is operatively associated with resistor 82 such that droplets of fluid are ejected from fluid ejection chamber 62 through nozzle opening 74 (e.g., substantially normal to the plane of resistor 82) and toward a print medium upon energization of resistor 82.

In one embodiment, printhead assembly 12 is a fully integrated thermal inkjet printhead. As such, substrate 40 is formed, for example, of silicon, glass, or a stable polymer, and thin-film structure 50 includes one or more passivation or insulation layers formed, for example, of silicon dioxide, silicon carbide, silicon nitride, tantalum, poly-silicon glass, or other material. Thin-film structure 50 also includes a conductive layer which defines resistor 82 and leads 84. The conductive layer is formed, for example, by aluminum, gold, tantalum, tantalum-aluminum, or other metal or metal alloy. In addition, barrier layer 60 is formed, for example, of a photoimageable epoxy resin, such as SU8, and orifice layer 70 is formed of one or more layers of material including, for example, a metallic material, such as nickel, copper, iron/nickel alloys, palladium, gold, or rhodium. Other materials, however, may be used for barrier layer 60 and/or orifice layer 70.

Figure 3:
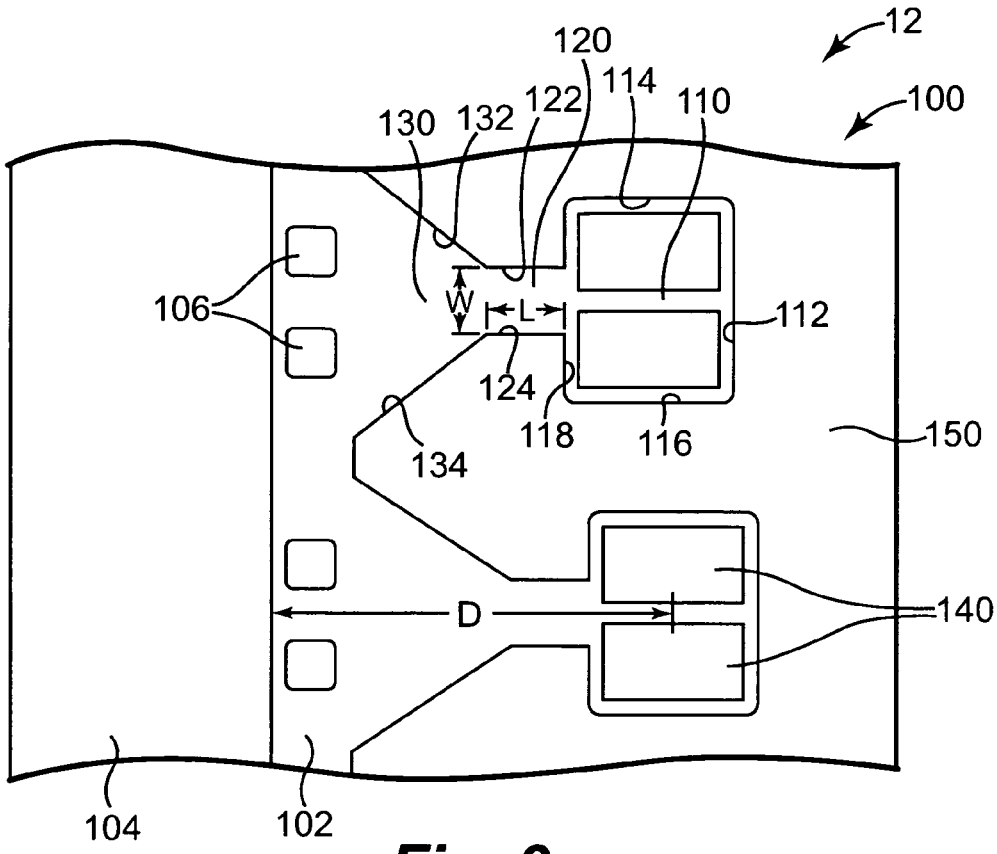
FIG. 3 is a plan view illustrating one embodiment of a portion of a fluid ejection device according to the present invention.

FIG. 3 illustrates one embodiment of a portion of a fluid ejection device, such as printhead 12, with the orifice layer removed. Fluid ejection device 100 includes a fluid ejection chamber 110, a fluid restriction 120, and a fluid channel 130. In one embodiment, fluid ejection chamber 110 includes an end wall 112, opposite sidewalls 114 and 116, and an end wall 118. As such, boundaries of fluid ejection chamber 110 are defined generally by end wall 112, opposite sidewalls 114 and 116, and end wall 118. In one embodiment, end walls 112 and 118 are oriented substantially parallel with each other, and sidewalls 114 and 116 are oriented substantially parallel with each other.

In one embodiment, fluid restriction 120 communicates with and is provided in a fluid flow path between fluid channel 130 and fluid ejection chamber 110. Parameters of fluid restriction 120 and fluid channel 130 are defined, as described below, to optimize operation or performance of fluid ejection device 100.

In one embodiment, fluid restriction 120 includes sidewalls 122 and 124, and fluid channel 130 includes sidewalls 132 and 134. In one embodiment, sidewalls 122 and 124 of fluid restriction 120 are substantially linear and oriented substantially parallel with each other. In addition, sidewalls 122 and 124 are each oriented substantially perpendicular to fluid ejection chamber 110 and, more specifically, end wall 118 of fluid ejection chamber 110. In addition, in one embodiment, sidewalls 132 and 134 of fluid channel 130 are substantially linear and are each oriented at an angle to fluid restriction 120 and, more specifically, sidewalls 122 and 124 of fluid restriction 120.

In one embodiment, fluid channel 130 communicates with a supply of fluid via a fluid feed slot 104 (only one edge of which is shown in the figure) formed in a substrate 102 of fluid ejection device 100. As described above, fluid channel 130 communicates with fluid restriction 120 and, as such, supplies fluid from fluid feed slot 104 to fluid ejection chamber 110 via fluid restriction 120. In one embodiment, one or more islands 106 are formed on substrate 102 of fluid ejection device 100 within fluid channel 130.

In one embodiment, a resistor 140, as one embodiment of a drop generator, is positioned within fluid ejection chamber 110 such that droplets of fluid are ejected from fluid ejection chamber 110 by activation of resistor 140, as described above. As such, the boundaries of fluid ejection chamber 110 are defined to encompass or surround resistor 140. In one embodiment, resistor 140 includes a split resistor. It is, however, within the scope of the present invention for resistor 140 to include a single resistor or multiple resistors.

Figure 4:
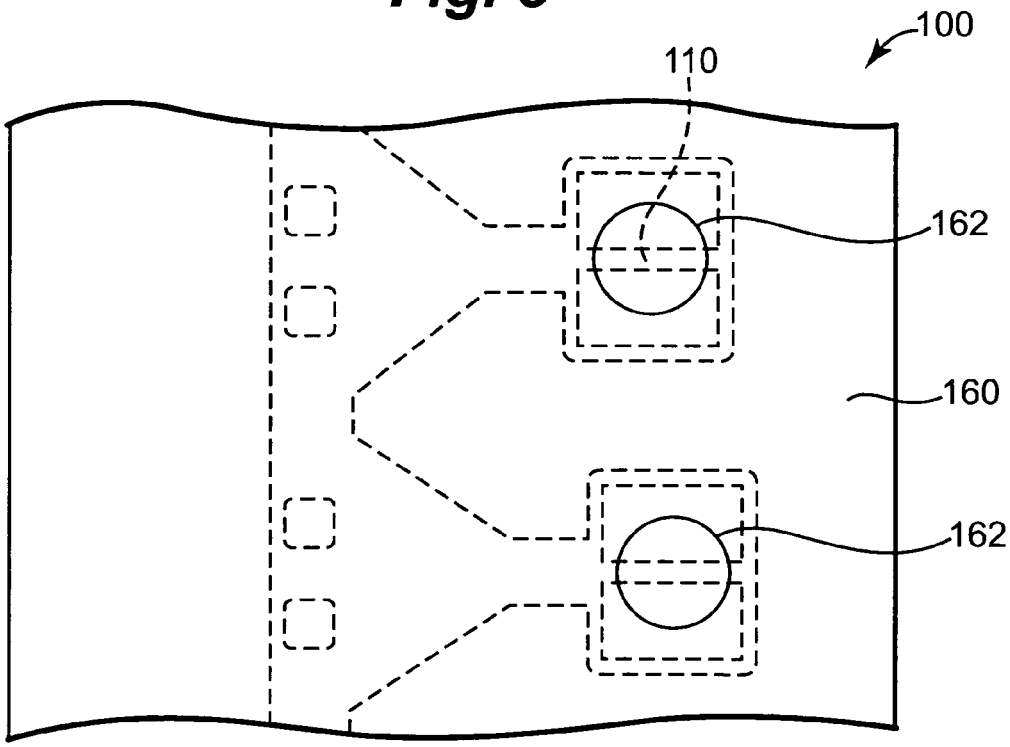
FIG. 4 is a plan view illustrating one embodiment of including an orifice layer with the fluid ejection device of FIG. 3.

In one embodiment, as illustrated in FIG. 3, fluid ejection chamber 110, fluid restriction 120, and fluid channel 130 of fluid ejection device 100 are defined in a barrier layer 150 as formed on substrate 102. In addition, in one embodiment, as illustrated in FIG. 4, an orifice layer 160 having an orifice 162 formed therein is extended over barrier layer 150 of fluid ejection device 100. Accordingly, orifice 162 communicates with fluid ejection chamber 110 such that fluid ejected from fluid ejection chamber 110 is expelled through orifice 162.

Figure 5:
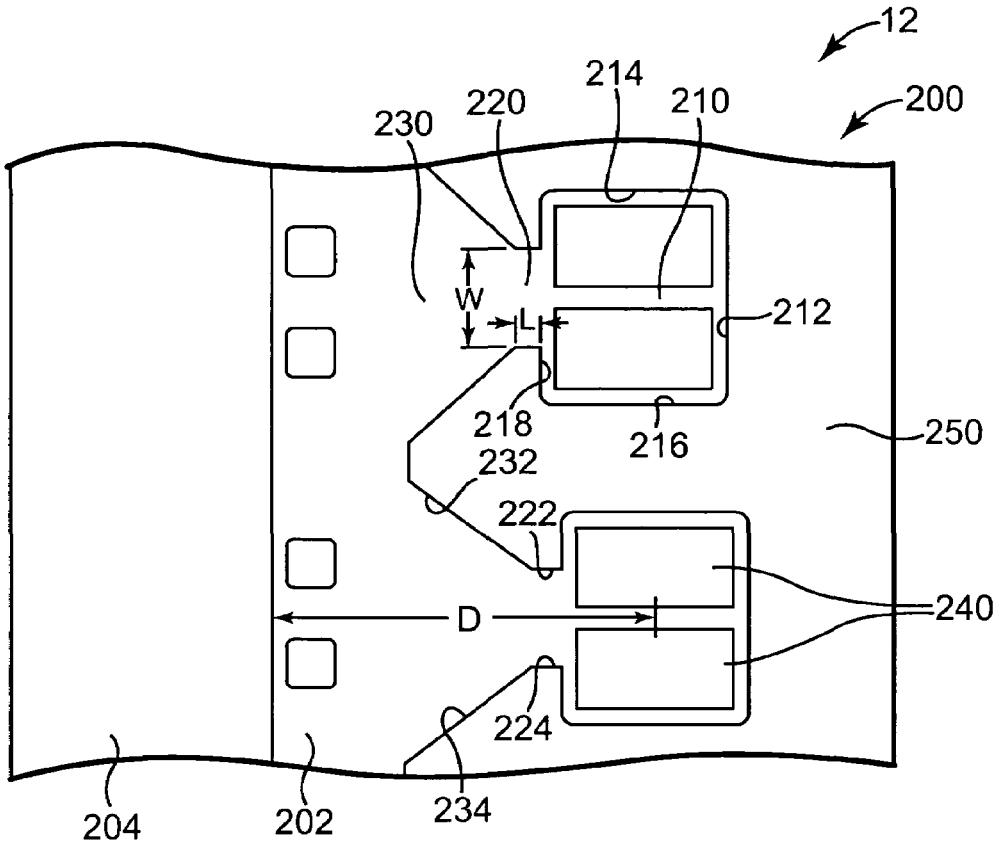
FIG. 5 is a plan view illustrating another embodiment of a portion of a fluid ejection device according to the present invention.

FIG. 5 illustrates another embodiment of a portion of a fluid ejection device, such as printhead 12, with the orifice layer removed. Fluid ejection device 200, similar to fluid ejection device 100, includes a fluid ejection chamber 210, a fluid restriction 220, and a fluid channel 230. In one embodiment, fluid ejection chamber 210 includes an end wall 212, sidewalls 214 and 216, and an end wall 218 arranged in a manner similar to that of fluid ejection chamber 110.

In one embodiment, fluid restriction 220 communicates with and is provided in a fluid flow path between fluid ejection chamber 210 and fluid channel 230. Similar to fluid restriction 120 and fluid channel 130 of fluid ejection device 100, parameters of fluid restriction 220 and fluid channel 230 are defined to optimize operation of fluid ejection device 200, as described below. In one embodiment, fluid restriction 220 and fluid channel 230 include respective sidewalls 222 and 224, and sidewalls 232 and 234 arranged in a manner similar to that of fluid ejection device 100.

In one embodiment, fluid channel 230 communicates with a supply of fluid via a fluid feed slot 204 (only one edge of which is shown in the figure) formed in a substrate 202 of fluid ejection device 200. In addition, similar to that described above, a resistor 240, as one embodiment of a drop generator, is positioned within fluid ejection chamber 210 such that droplets of fluid are ejected from fluid ejection chamber 210 by activation of resistor 240.

Figure 6:
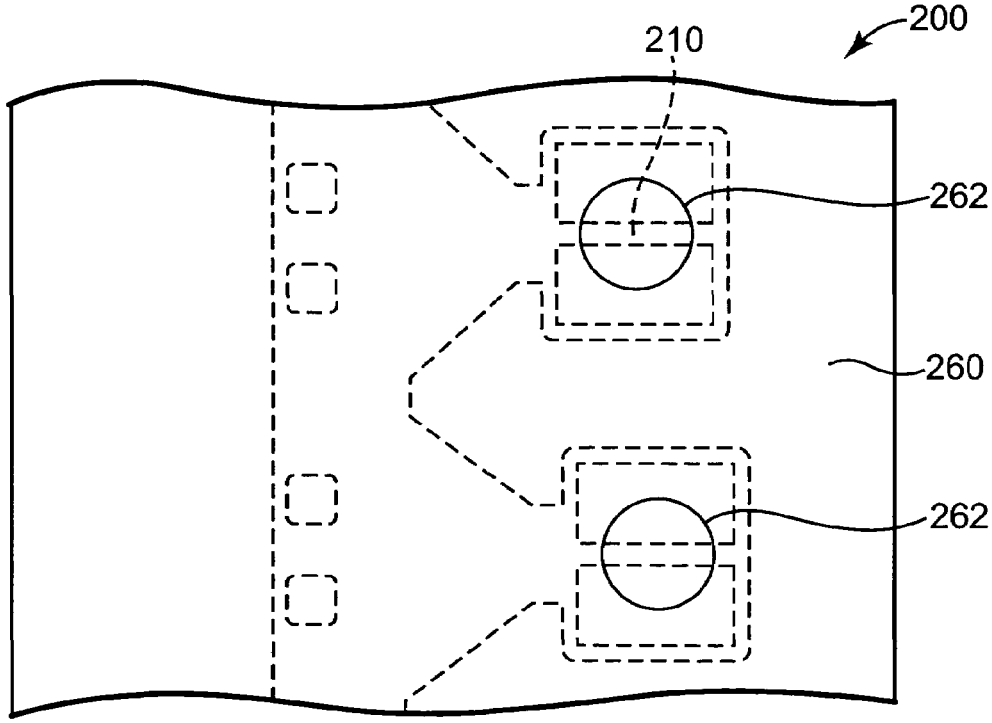
FIG. 6 is a plan view illustrating one embodiment of including an orifice layer with the fluid ejection device of FIG. 5.

As illustrated in the embodiment of FIG. 5, and similar to that described above with reference to fluid ejection device 100, fluid ejection chamber 210, fluid restriction 220, and fluid channel 230 of fluid ejection device 200 are defined in a barrier layer 250 as formed on substrate 202. In addition, as illustrated in the embodiment of FIG. 6, an orifice layer 260 having an orifice 262 formed therein is extended over barrier layer 250 of fluid ejection device 200. Accordingly, orifice 262 communicates with fluid ejection chamber 210 such that fluid ejected from fluid ejection chamber 210 is expelled through orifice 262.

In one embodiment, a plurality of fluid ejection devices 100 and/or 200 are formed on a common substrate and are arranged to substantially form one or more columns of drop ejecting elements. As such, drop ejecting elements of respective fluid ejection devices 100 and/or 200 may be used for ejecting different color inks from printhead 12. In one exemplary embodiment, fluid ejection device 100 is optimized for use with black ink and fluid ejection device 200 is optimized for use with a colored ink, as described below.

In one embodiment, as illustrated in FIGS. 3-6 and as outlined in the table of FIG. 7, various parameters of fluid ejection device 100 and fluid ejection device 200 are selected to optimize or improve performance of fluid ejection device 100 or fluid ejection device 200. In one embodiment, for example, a pinch width W and a pinch length L of fluid restrictions 120 and 220 is optimized. In addition, a shelf length or distance D from an edge of fluid feed slots 104 and 204 to a center of respective fluid ejection chambers 110 and 210 is optimized. In one embodiment, an area of resistors 140 and 240, and a diameter of orifices 162 and 262 is also optimized.

In one exemplary embodiment, as illustrated in the table of FIG. 7, a thickness T of barrier layers 150 and 250, as well as a thickness t of orifice layers 160 and 260 is generally fixed. In one embodiment, thickness T of barrier layers 150 and 250 establishes the height or depth of fluid ejection chambers 110 and 210, fluid restrictions 120 and 220, and fluid channels 130 and 230. Thus, by optimizing select parameters of fluid ejection devices 100 and 200, as described above, the volume and/or rate of fluid supplied to fluid ejection chambers 110 and 210 can be optimized.

In one embodiment, pinch width W of fluid restrictions 120 and 220 is measured between respective sidewalls 122 and 124 and sidewalls 222 and 224 and is substantially constant. In addition, pinch length L of fluid restrictions 120 and 220 is measured along respective sidewalls 122 and 124 and sidewalls 222 and 224 between sidewalls 132 and 134, and sidewalls 232 and 234 of respective fluid channels 130 and 230 and end walls 118 and 218 of respective fluid ejection chambers 110 and 120.

In one embodiment, the feed rate of fluid ejection chambers 110 and 210 is directly proportional to the cross-sectional area of respective fluid restrictions 120 and 220. Accordingly, the cross-sectional area of fluid restrictions 120 and 220 is defined by the height or depth of fluid restrictions 120 and 220 and the width of fluid restrictions 120 and 220. As such, in one embodiment, the cross-sectional area of fluid restrictions 120 and 220 is substantially rectangular in shape. The cross-sectional area of fluid restrictions 120 and 220, however, may be other shapes.

In one embodiment, the total impedance to flow through fluid restrictions 120 and 220 to respective fluid ejection chambers 110 and 210 is optimized so as to avoid overfilling of fluid ejection chambers 110 and 210. As such, fluid ejection devices 100 and 200 are optimized so as to maintain a substantially constant impedance to flow of fluid to respective fluid ejection chambers 110 and 210 over a desired operating range. In one exemplary embodiment, fluid ejection devices 100 and 200 are each optimized so as to maintain a substantially constant impedance to flow of fluid to respective fluid ejection chambers 110 and 210 over an operating range up to at least approximately 36 kilohertz.

In one embodiment, in addition to optimizing parameters of fluid ejection devices 100 and 200, as described above, properties of fluid ejected from fluid ejection devices 100 and 200 are also optimized to optimize performance of fluid ejection devices 100 and 200. For example, properties of fluid ejected from fluid ejection devices 100 and 200 are optimized to optimize drop weight and drop velocity of droplets ejected from fluid ejection devices 100 and 200, as well as optimize a high frequency response of fluid ejection devices 100 and 200.

In one embodiment, for example, surface tension and/or viscosity of fluid ejected from fluid ejection devices 100 and 200 is optimized to optimize performance of fluid ejection devices 100 and 200. In one exemplary embodiment, surface tension of the fluid ejected from fluid ejection devices 100 and 200 is in a range of approximately 20 dynes/centimeter to approximately 60 dynes/centimeter, and viscosity of the fluid ejected from fluid ejection devices 100 and 200 is in a range of approximately 1.5 centipoise to approximately 3.0 centipoise.

In one embodiment, fluid ejection devices 100 and 200 are optimized to produce droplets of substantially uniform or constant drop weight. In one exemplary embodiment, a drop weight of droplets ejected from fluid ejection devices 100 and 200 is in a range of approximately 4 nanograms to approximately 7 nanograms. In addition, in one embodiment, a frequency at which droplets of fluid are ejected from fluid ejection devices 100 and 200 is also optimized to optimize performance of fluid ejection devices 100 and 200.

In one embodiment, knowing the ink viscosity as well as drop velocity and drop weight needs, resistor and orifice dimensions may be optimized wherein resistor size is defined as a square root of the resistor area and orifice size is defined as the diameter of the orifice opening. As such, a resistor-to-orifice ratio may be established for generating the desired drop velocity. In one exemplary embodiment, the resistor-to-orifice ratio is approximately 1.4 such that drop velocity increases by approximately 8 percent for each 0.1 unit increase in the ratio. Accordingly, resistor size and orifice size at the designed resistor-to-orifice ratio may be determined for generating the desired drop weight. In one exemplary embodiment, drop weight increases by approximately 0.3 nanograms per micron increase in resistor size and increases by approximately 0.6 nanograms per micron increase in orifice size. In addition, ink viscosity adjustments may be made using the relationship of 0.25 nanograms increase in drop weight per centipoise decrease in viscosity.

Figure 8:
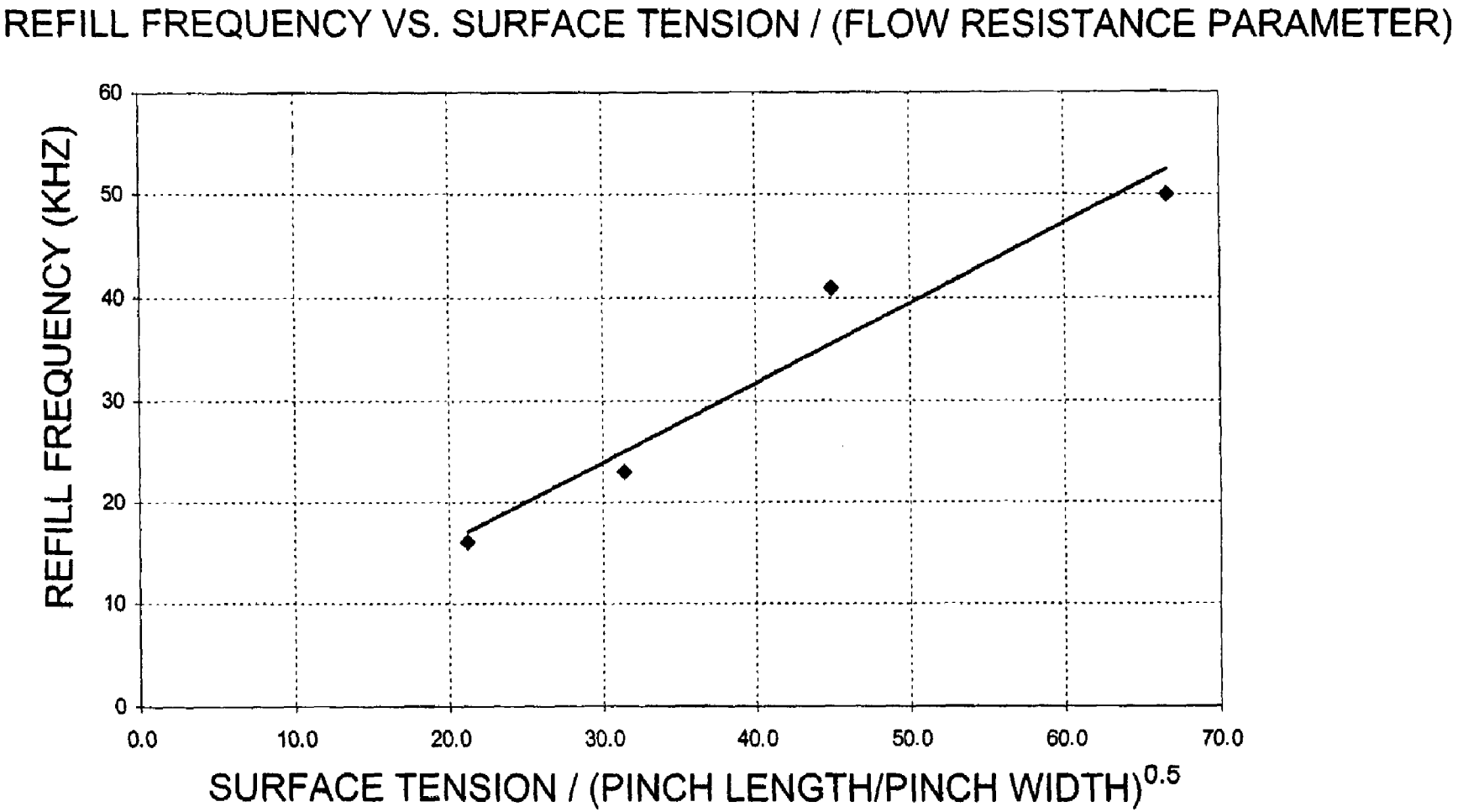
FIG. 8 is a graph illustrating one embodiment of refill frequency versus a ratio of fluid surface tension to fluid flow resistance for a fluid ejection device according to the present invention.

In one embodiment, as illustrated in the graph of FIG. 8, refill frequency of fluid ejection devices 100 and 200 and, therefore, the frequency at which droplets of fluid can be ejected from fluid ejection devices 100 and 200 varies with surface tension of the fluid and the flow resistance presented to the fluid. In one embodiment, refill frequency is linearly proportional to the surface tension of the ink and linearly proportional to the shelf length. In addition, refill frequency is inversely proportional to a flow resistance parameter such as the square root of pinch length/pinch width. As such, with known surface tension of the fluid and known system operating frequency needs, pinch width W and pinch length L, as well as shelf length D may be optimized.

In one embodiment, as described above, fluid ejection device 100 is tuned to optimize performance with one fluid (or ink), such as a black ink, and fluid ejection device 200 is tuned to optimize performance with another fluid (or ink), such as a colored ink. Parameters of fluid ejection devices 100 and 200, such as pinch width W and pinch length L of respective fluid restrictions 120 and 220, as well as shelf length D, therefore, are selected to optimize the respective performance. Parameters of fluid ejection devices 100 and 200, however, remain within the overall system ranges. Accordingly, fluid ejection devices 100 and 200 may accommodate one or more different inks while being designed within the same system parameters.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection system, comprising:

first and second fluid supplies;

first and second fluid restrictions communicated with respective of the first and second fluid supplies; and first and second fluid chambers communicated with respective of the first and second fluid restrictions, wherein the first fluid restriction has a width in a range of 8 microns to 10 microns and a length in a range of 10 microns to 20 microns, and the second fluid restriction has a width in a range of 10 microns to 16 microns and a length in a range of 5 microns to 10 microns.

2. The fluid ejection system of claim 1, further comprising:

first and second fluid feed slots communicated with respective of the first and second fluid supplies and respective of the first and second fluid chambers via respective of the first and second fluid restrictions, wherein a distance from an edge of the first fluid feed slot to a center of the first fluid chamber is in a range of 61 microns to 71 microns, and a distance from an edge of the second fluid feed slot to a center of the second fluid chamber is in a range of 51 microns to 61 microns.

3. The fluid ejection system of claim 1, further comprising:

first and second resistors formed within respective of the first and second fluid chambers, wherein the first resistor has an area of 400 square microns and the second resistor has an area of 450 square microns.

4. The fluid ejection system of claim 1, further comprising:

first and second orifices communicated with respective of the first and second fluid chambers, wherein the first orifice has a diameter of 14 microns and the second orifice has a diameter of 15 microns.

5. The fluid ejection system of claim 1, wherein fluid of the first fluid supply has a surface tension of 58 dynes/centimeter and a viscosity of 1.8 centipoise, and fluid of the second fluid supply has a surface tension of 29 dynes/centimeter and a viscosity of 2.5 centipoise.

6. The fluid ejection system of claim 1, wherein the system is adapted to eject drops of fluid of the first fluid supply from the first fluid chamber at a frequency up to at least 24 kilohertz with each of the drops having a weight of 6 nanograms, and eject drops of fluid of the second fluid supply from the second fluid chamber at a frequency up to at least 36 kilohertz with each of the drops having a weight of 5 nanograms.

7. The fluid ejection system of claim 1, wherein the first fluid supply includes a black ink and the second fluid supply includes a colored ink.

8. A fluid ejection system, comprising:

first and second fluid supplies;

first and second fluid restrictions communicated with respective of the first and second fluid supplies;

first and second fluid chambers communicated with respective of the first and second fluid restrictions; and first and second fluid feed slots communicated with respective of the first and second fluid supplies and respective of the first and second fluid chambers via respective of the first and second fluid restrictions, wherein a distance from an edge of the first fluid feed slot to a center of the first fluid chamber is in a range of 61 microns to 71 microns, and a distance from an edge of the second fluid feed slot to a center of the second fluid chamber is in a range of 51 microns to 61 microns, and wherein the first fluid restriction has a width in a range of 8 microns to 10 microns and a length in a range of 10 microns to 20 microns, and the second fluid restriction has a width in a range of 10 microns to 16 microns and a length in a range of 5 microns to 10 microns.

9. The fluid ejection system of claim 8, further comprising:

first and second resistors formed within respective of the first and second fluid chambers, wherein the first resistor has an area of 400 square microns and the second resistor has an area of 450 square microns.

10. The fluid ejection system of claim 8, further comprising:

first and second orifices communicated with respective of the first and second fluid chambers, wherein the first orifice has a diameter of 14 microns and the second orifice has a diameter of 15 microns.

11. The fluid ejection system of claim 8, wherein fluid of the first fluid supply has a surface tension of 58 dynes/centimeter and a viscosity of 1.8 centipoise, and fluid of the second fluid supply has a surface tension of 29 dynes/centimeter and a viscosity of 2.5 centipoise.

12. The fluid ejection system of claim 8, wherein the system is adapted to eject drops of fluid of the first fluid supply from the first fluid chamber at a frequency up to at least 24 kilohertz with each of the drops having a weight of 6 nanograms, and eject drops of fluid of the second fluid supply from the second fluid chamber at a frequency up to at least 36 kilohertz with each of the drops having a weight of 5 nanograms.

13. The fluid ejection system of claim 8, wherein the first fluid supply includes a black ink and the second fluid supply includes a colored ink.

* * * * *